United States Patent [19]

Kelley et al.

[11] Patent Number: 4,785,557

[45] Date of Patent: Nov. 22, 1988

[54] SHOE SOLE CONSTRUCTION

[75] Inventors: Brenda Kelley; James K. Tong, both of Portland, Oreg.

[73] Assignee: AVIA Group International, Inc., Portland, Oreg.

[21] Appl. No.: 923,119

[22] Filed: Oct. 24, 1986

[51] Int. Cl.[4] ..... A43B 13/04; A43B 13/16

[52] U.S. Cl. ..... 36/32 R; 36/30 R; 36/31

[58] Field of Search ..... 36/30 R, 32 R, 28, 31, 36/91, 102, 103, 114; 128/586, 610

[56] References Cited

U.S. PATENT DOCUMENTS

| | | | |
|---|---|---|---|
| Re. 31,173 | 3/1983 | Daswick | 36/30 R |
| D. 268,221 | 3/1983 | Argyropoulos | D2/322 |
| D. 268,299 | 3/1983 | Argyropoulos | D2/322 |
| 2,884,717 | 5/1959 | Goldberg | 128/610 |
| 2,931,110 | 4/1960 | Pietrocola | 36/30 R |
| 3,027,661 | 4/1962 | McCord | 36/30 R |
| 3,936,956 | 2/1976 | Famolare, Jr. | 36/32 R |
| 4,041,618 | 8/1977 | Famolare, Jr. | 36/25 R |
| 4,241,523 | 12/1980 | Daswick | 36/30 R |
| 4,259,792 | 4/1987 | Halberstadt | 36/32 R |
| 4,262,433 | 4/1981 | Hagg et al. | 36/25 R |
| 4,316,334 | 2/1982 | Hunt | 36/91 |
| 4,335,530 | 6/1982 | Stubblefield | 36/83 |
| 4,348,821 | 9/1982 | Daswick | 36/103 |
| 4,372,058 | 2/1983 | Stubblefield | 36/32 R |
| 4,372,059 | 2/1983 | Ambrose | 36/32 R |
| 4,398,357 | 8/1983 | Batra | 36/31 |
| 4,399,621 | 8/1983 | Dassler | 36/32 R |
| 4,481,727 | 11/1984 | Stubblefield | 36/83 |
| 4,564,966 | 1/1986 | Chen | 36/32 R |
| 4,638,576 | 1/1987 | Parracho et al. | 36/30 R |
| 4,676,010 | 6/1987 | Cheskin | 36/32 R |
| 4,694,591 | 9/1987 | Bamch et al. | 36/30 R |

FOREIGN PATENT DOCUMENTS

| | | |
|---|---|---|
| 974150 | 2/1951 | Switzerland . |
| WO83/04166 | 8/1983 | World Int. Prop. O. . |

OTHER PUBLICATIONS

Runner's World, vol. 11, Mar., 1976—No. 3, New Balance Competition.

Pedoscope, vol. 15, No. 2, p. 5 (Mar./Apr. 1986) "Woman's Casual Shoe and Men's Leather Oxford".

*Primary Examiner*—Steven N. Meyers

*Attorney, Agent, or Firm*—Saidman, Sterne, Kessler & Goldstein

[57] ABSTRACT

A shoe sole construction especially designed for but not limited to walking shoes, comprising a sole having a midsole and two substantially U-shaped outer sole sections. One outer sole section is secured to the peripheral portion of the midsole in the rear portion and the second outer sole is secured to the peripheral portion of the midsole in the front portion leaving exposed the entirety of the midsole between the two U-shaped outer sole sections. An arch extension extends integrally from the middle portion of the midsole in the area below the arch of the wearer. The arch extension extends below the front and rear sections of the midsole and below the plane of the outer sole sections. The arch extension may further include an enlarged region adjacent the peripheral portion of the medial side of the shoe. The midsole of the present invention may also include cantilever means for cushioning the foot of the wearer as the peripheral portion of the midsole extends downwardly below the inner portion of the midsole to support the inner portion in cantilever fashion. The unique shoe sole construction could also be used for running shoes or other athletic shoes.

16 Claims, 2 Drawing Sheets

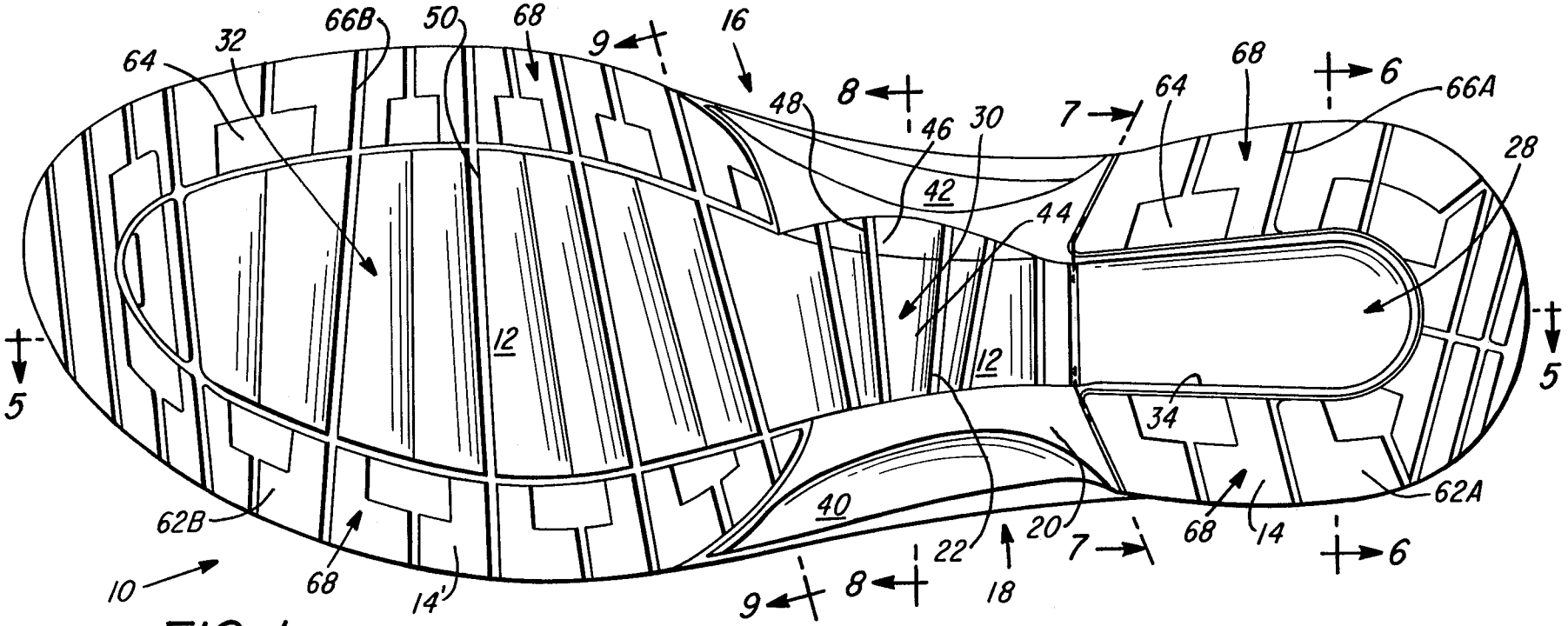
FIG. 1
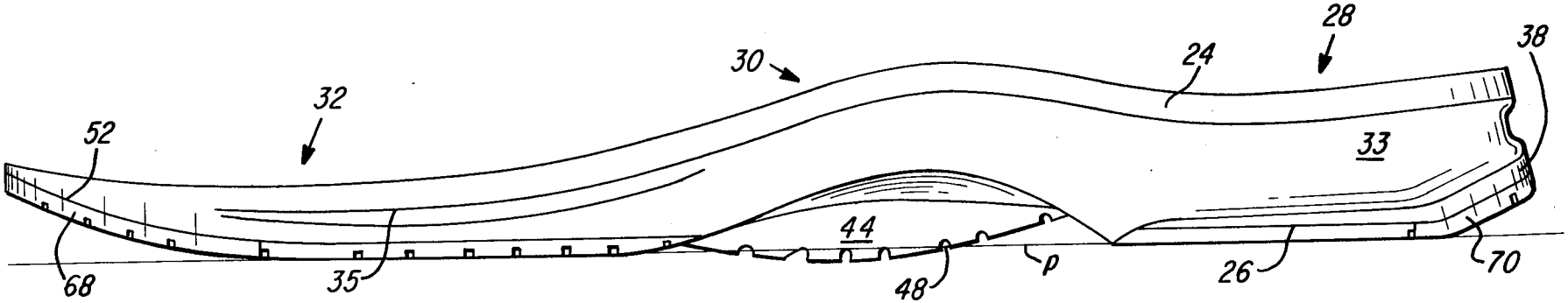
FIG. 2 (MEDIAL SIDE)

SHOE SOLE CONSTRUCTION

BACKGROUND OF THE INVENTION

1. Field of the Invention

The present invention is related to shoes and more particularly is directed towards an improved shoe sole especially designed for but not limited to a walking shoe.

2. Description of Related Arts

Walking as a form of exercise continues to increase in popularity as medical studies continue to show the health benefits derived from walking. However, walking, whether for exercise, recreation or any other purpose puts stress on the wearer's feet and legs. This stress can cause injuries to the walker if proper shoes are not worn. Furthermore, improper shoes can hinder the walking motion which not only slows down the walker but requires the wearer to exert unnecessary energy. Improper shoes can therefore prevent the wearer from obtaining the full benefits attributable to walking. Therefore, the need exists for a walking shoe which will aid the walking motion and prevent injuries to the wearer.

Prior shoe soles have been unable to successfully combine lightweightness, stability, wear resistance and cushioning—features widely recognized as ideal for shoe soles. Instead these prior soles sacrifice one of these features at the expense of another. For example, to construct a dense shoe sole in order to provide stability and wear resistance, the sole is exceedingly heavy in weight and therefore hinders the walking motion by causing the wearer to unnecessarily work harder. It could also be frustrating to a walker who is in a training program. On the other hand, prior attempts to develop a lightweight shoe sole to aid the wearer's movement and facilitate walking have resulted in sacrificing wear resistance, stability and cushioning. The sacrifice of wear resistance results in the inability of the shoe sole to withstand the constant contact with the ground and therefore the usefulness of the shoe sole will be short-lived. The sacrifice of stability and cushioning results in injuries to the wearer by not properly countering the forces generated in walking.

Furthermore, prior shoe sole constructions have been unable to successfully combine these features into a sole which accommodates the gait of a walker. After impact of the heel with the ground the foot naturally rolls forwardly to the arch and then continues towards the toe. Additionally, most individual's feet turn inwardly (pronate) during the forward rolling motion. Therefore, there exists a need for a shoe sole which would aid the forward rolling motion through the arch area of the wearer to facilitate the walking motion and to accommodate the inward movement of the foot towards the medial side, while still combining the advantageous features enumerated above.

The need also exists for a shoe sole which combines these features plus aids the forward rolling motion through the arch of the wearer to facilitate running or other athletic activities as well.

SUMMARY OF THE INVENTION

The present invention overcomes the aforementioned deficiencies and drawbacks of prior shoe sole constructions. The present invention provides a shoe sole construction wherein the sole includes a lateral side and a medial side. The sole comprises a midsole having inner and peripheral portions and front, middle and rear portions. A first U-shaped outer sole section is secured to the peripheral portion of the midsole in the rear portion and a second U-shaped outer sole section is secured to the peripheral portion of the midsole in the front portion.

An arch extension extending from the middle portion of the midsole in the area below the arch of the wearer is provided. The arch extension is disposed along the longitudinal axis of the sole in the inner portion of the midsole and extends below the plane of the outer sole sections. The arch extension includes an enlarged region adjacent the peripheral portion of the medial side of the shoe. The arch extension is of greater vertical thickness on the medial side than on the lateral side.

The midsole progressively decreases in vertical thickness from the middle portion to the front portion and from the middle portion to the rear portion. The midsole preferably comprises a raised toe area, an upwardly tapered heel area and first and second indentations disposed on the bottom surface of the midsole, one on each side of the arch extension. A plurality of grooves are formed on the bottom surface of the midsole wherein the grooves extend substantially transversely across the midsole.

The outer sole sections each are preferably of uniform thickness and comprise a plurality of peripheral treads. One of the outer sole sections includes a plurality of spaces disposed between the peripheral treads wherein the spaces are in substantial alignment with the grooves of the midsole.

The present invention may provide a midsole having toe, arch and heel portions and a bototm surface. An outer sole having front and rear sections is secured to the bottom surface of the toe and heel portions of the midsole respectively. The outer sole further includes a lower surface, and a cutout portion extending at least along the longitudinal axis of the sole from the front section to the rear section. The midsole includes an arch extension extending substantially along the longitudinal axis of the sole. The bottom surface of the arch extension extends through the cutout portion and below the toe and heel portions of the midsole. The arch extension may also extend below the lower surface of the outer sole. Alternately, the lower surface of the outer sole may be substantially flush with the bottom surface of the arch extension or may extend below the bottom surface of the arch extension. The arch extension may further comprise an enlarged region adjacent the peripheral portion of the medial side of the midsole and is preferably of greater vertical thickness on its medial side then on its lateral side.

The front and rear sections of the outer sole each comprise a lower density side area. A portion of the front and rear sections of the outer sole are curved upwardly and cooperate with the sections of the upwardly tapered toe and heel portions of the midsole.

The present invention may also include means for absorbing shock resulting from foot initiated ground impact and for cushioning the foot of the wearer comprising a sole having front and rear portions and lateral and medial peripheral portions. The bottom surface of the sole is inclined upwardly and inwardly from the medial peripheral portion and from the lateral peripheral portion to define a lateral concavity between the lateral and medial peripheral portions. A convex arch extension is disposed between the medial and lateral peripheral portions and extends substantially along the longitudinal axis of the sole in the approximate area of the arch of the wearer. The extension extends below the front and rear portions of the sole. The outer sole may include a cutout portion extending substantially along the longitudinal axis of the sole from the front section to the rear section. The midsole extends into the cutout portion and the convex arch extension extends integrally from the midsole through the cutout portion.

The means for cushioning the foot of a wearer and absorbing shock resulting from foot-initiated ground impact comprises cantilever means. The cantilever means comprises a midsole having toe, arch and heel portions and peripheral and inner portions wherein the peripheral portion extends downwardly below the inner portion to support the inner portion.

The rear section of the midsole is recessed to define a concavity. A channel is preferably formed between the top and bottom surfaces in the toe portion and in the heel portion of the midsole.

BRIEF DESCRIPTION OF THE DRAWINGS

Various objects, features, and attendant advantages of the present invention will be more fully appreciated as the same becomes better understood from the following detailed description of the present invention when considered in connection with the accompanying drawings, in which:

FIG. 1 is a bottom view of a preferred embodiment of the shoe sole of the present invention;

FIG. 2 is a right side elevational view of the shoe sole of FIG. 1;

DETAILED DESCRIPTION OF THE PREFERRED EMBODIMENT

Figure 3:
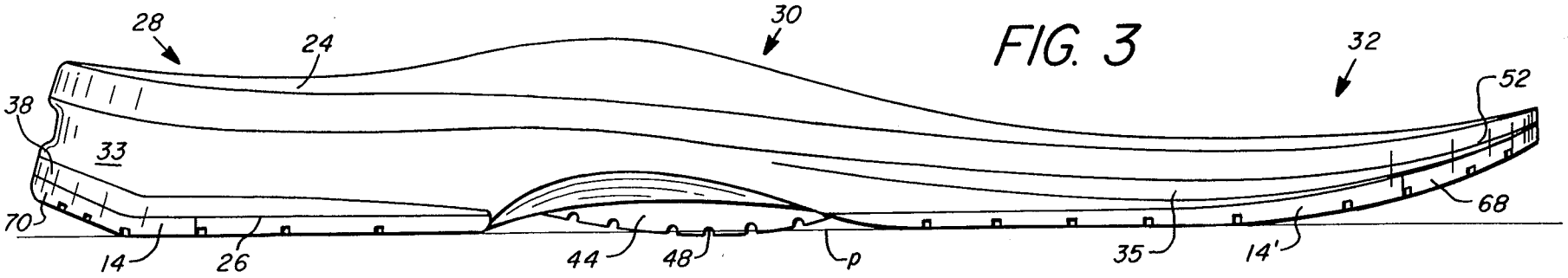
FIG. 3 is a left side elevational view of the shoe sole of FIG. 1.

Referring now to the drawings, wherein like reference numerals represent identical or corresponding parts throughout the several views, and more particularly to FIG. 1 the shoe sole of the present invention is indicated generally by reference numeral 10. The medial side of the sole 10 is designated generally by reference numeral 16 and the lateral side of the sole 10 is designated generally by reference numeral 18. The shoe sole includes a midsole 12, preferably composed of polyurethane, and a two-piece rubber outer sole. The outer sole comprises a rear foot outer sole section 14 and a forefoot outer sole section 14' which are each secured along peripheral portions of the midsole 12 (see also FIG. 5).

As shown in FIG. 1, the midsole 12 generally includes a peripheral portion 20 and an inner portion 22. The midsole 12 also generally includes a rear or heel section 28, a middle or arch section 30, and a front or toe section 32.

With reference to FIGS. 2 and 3, midsole 12 further includes a bottom surface or wall 26 and a top surface 24 which preferably conforms to the shape of the last bottom. The top surface 24 of midsole 12 is designed to be secured in any conventional fashion to an upper which receives the foot of the wearer.

It should be noted that all references to top and bottom surfaces and to vertical measurements are based on the view of the sole illustrated in FIGS. 2–9 in which the bottom surface corresponds to the portion adapted to contact the ground. Obviously, if the orientation of the sole is changed than the surfaces and vertical references will also change accordingly.

Figure 8:
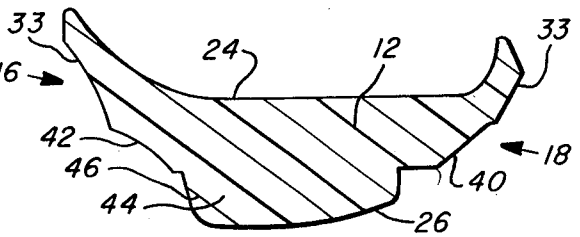
FIG. 8 is a cross-sectional view of the shoe sole taken along line 8—8 of FIG. 1.

The inner portion 22 of midsole 12 is preferably and advantageously supported at least in the heel section 28 in a cantilever fashion by the peripheral portion 20 in order to cushion the foot of the wearer and to dissipate shock away from the foot of the wearer upon ground impact. A cantilever sole construction is disclosed in U.S. Pat. No. 4,372,058 to Stubblefield (expressly incorporated herein by reference) in which tread members extend integrally from the peripheral portions of the outer sole and have outwardly and downwardly inclined portions or walls that form a general lateral concavity. The lower extremities of the treads are adapted to flex upwardly and outwardly relative to the shoe upper upon ground impact. Therefore, the central portion of the outer sole directly below the foot is supported in cantilever fashion by the treads and flexes downwardly in a trampoline-like action upon ground impact. In FIG. 8 of U.S. Pat. No. 4,372,058, the midsole has a curved lower surface that essentially forms the concavity and the outer sole has peripheral tread members cooperating with the midsole to support the center portion of the midsole in cantilever fashion.

Figure 7:
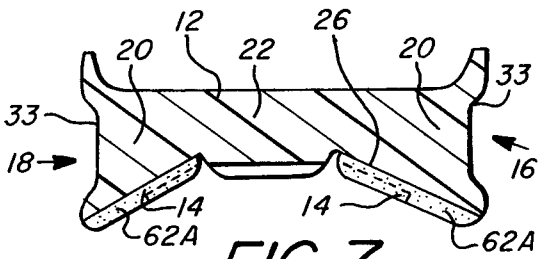
FIG. 7 is a cross-sectional view of the shoe sole taken along line 7—7 of FIG. 1.
Figure 9:
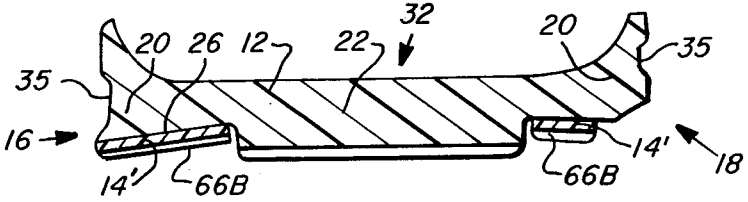
FIG. 9 is a cross-sectional view of the shoe sole taken along line 9—9 of FIG. 1.
Figure 6:
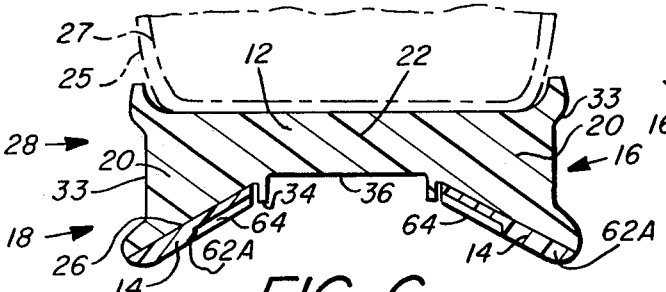
FIG. 6 is a cross-sectional view of the shoe sole taken along line 6—6 of FIG. 1.
Figure 4:
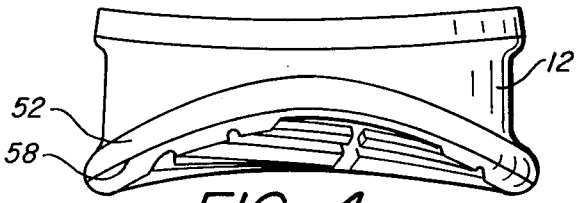
FIG. 4 is a front view of the shoe sole of FIG. 1.

As can be appreciated from FIGS. 6, 7 and 9, in the present invention the center portion 22 of midsole 12 is similarly supported in cantilever fashion as the peripheral portions 20 on both the medial side 16 and on the lateral side 18 extend downwardly and outwardly from the inner portion 22. That is, the bottom wall of midsole 12 extends upwardly and inwardly from the peripheral portion 20 to inner portion 22, thereby forming a general lateral concavity on the bottom of the shoe.

As illustrated in FIG. 6, which shows a cross sectional view of the sole in heel section 28, the peripheral portion 20 of midsole 12 also extends laterally beyond an upper shown in dotted outline and designated by reference numeral 25. The foot of the wearer, also shown in dotted line and indicated by reference numeral 27, is received within upper 25 and the area under the foot 27 lies directly above the inner portion 22 of midsole 12 which is relatively thin compared to the peripheral portion 20 which is relatively thick. The peripheral portion 20 preferably extends laterally beyond the area directly below the foot so that the wearer's weight will be concentrated laterally inwardly thereof. Therefore, inner portion 22 and consequently the foot above it is supported in cantilever fashion by the peripheral portion 20 to resiliently cushion the foot as the shoe comes into maximum ground contact. This resilient cushioning is characterized by the peripheral portion 20 spreading outwardly on the medial side 16 and lateral side 18 and the inner portion 22 flexing downwardly towards the ground upon ground impact. It should also be noted that rear foot outer sole section 14, which is secured to the midsole 12 in the heel section 28, is preferably of substantially uniform thickness in order to cooperate with midsole 12 to support the inner portion 22 of midsole 12 in cantilever fashion. By providing an inclined midsole 12 and a thinner outer sole of uniform thickness rather than an inclined outer sole the overall weight of the sole is advantageously reduced since the midsole material is lighter.

As can be seen by comparing FIGS. 6, 7 and 9, the angle of inclination of the bottom wall 26 of midsole 12, relative to the ground, differs along various cross-sections of the sole. The greatest angle of inclination, is in the heel section 28 which is shown in FIG. 6. The angle of inclination progressively decreases towards the toe section 32; FIG. 9, showing a small angle of inclination in toe section 32.

Additionally, as can be readily seen in FIG. 9, the inclined bottom wall 26 of midsole 12 is preferably longer on the medial side 16 than on the lateral side 18 and the angle of inclination is preferably greater on the medial side 16.

Referring to FIGS. 2 and 3, 6 and 7, disposed in the side walls of midsole 12 is a rear channel 33 which preferably extends from the medial side 16 of arch section 30 around heel section 28 to the lateral side 18 of arch section 30. Rear channel 33 allows the peripheral portion 20 and cooperating rear foot outer sole section 14 to flex more readily upwardly since there is no resistance to movement directly thereabove, as explained in U.S. Pat. No. 4,449,307 to Stubblefield. A front channel 35 is preferably formed in the side walls of midsole 12 on the medial side 16 and on the lateral side 18 in the toe section 32.

Figure 5:
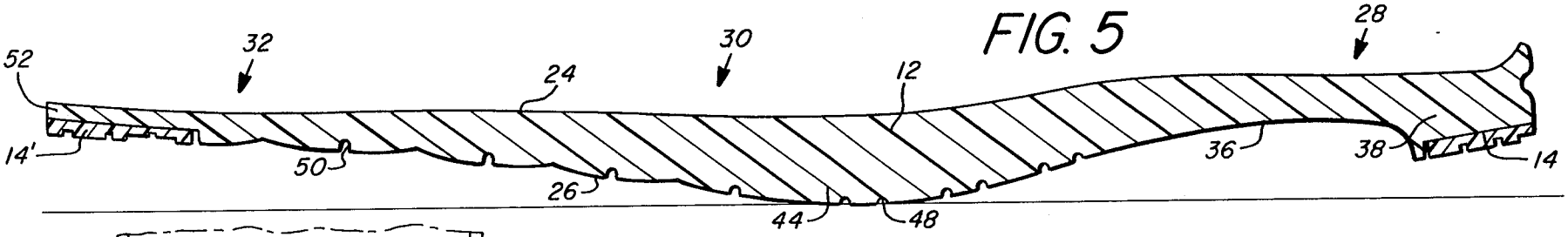
FIG. 5 is a longitudinal sectional view of the shoe sole illustrated in FIG. 1 and taken along line 5—5 thereof.

As apparent from FIG. 5, the vertical thickness of midsole 12 measured from the top surface 24 to the bottom surface 26, varies from heel section 28 to toe section 32. More specifically, the thickest section of midsole 12 is the arch section 30 as the thickness of midsole 12 progressively decreases from the arch section 30 towards the toe section 32 and towards the heel section 28. The midsole 12 slightly increases again in thickness in the rearmost region of the heel section 28. At the rearmost region of heel section 28 where the midsole slightly increases in vertical thickness is a upwardly tapered heel area 38.

Turning now to a detailed discussion of heel section 28 of midsole 12, and with particular reference to FIG. 6, centered on the bottom surface 26 is a rim 34 which defines a recess 36. The recess 36 cooperates with the concavity formed by the cantilevered midsole 12 discussed above, as it is located in the inner portion 22 of midsole 12 between the lower extending peripheral portions 20. The recess 36 as shown in FIG. 5, preferably extends along the longitudinal axis of midsole 12 in the rear section 28 and the depth of the recess 36 decreases towards arch section 30 as the thickness of midsole 12 increases. This recess 36 not only reduces the weight of midsole 12 by reducing the amount of midsole material, but allows the peripheral portion 20 and cooperating rear foot outer sole section 14 to flex easier.

With specific reference to FIGS. 2, 3, 5 and 8, the arch section 30 of midsole 12 includes an arch extension 44, preferably convex in shape and extending integrally from the bottom surface 26 of midsole 12. The arch extension 44 extends below toe section 32 and heel section 28, preferably one millimeter below the rear section 28 (FIG. 3), although other size extensions and extensions of varying thickness can be utilized. For example, the thickness of the extension may be reduced when the shoe sole construction of the present invention is designed for a running shoe. The thickness can also be varied since the extent of contact with the ground will vary depending on the compression of the cantilever sole discussed above.

Arch extension 44 preferably extends below outer sole sections 14 and 14' as shown in relation to plane P of FIGS. 2 and 3 which is drawn parallel to the ground and extends along the entire length of the sole. However in alternate embodiments the outer sole section 14 may be susbstantially flush with the lower surface of arch extension 44 or may extend below the lower surface of arch extension 44.

The arch extension 44 extends downwardly from inner portion 22 and extends along the longitudinal axis of the sole in arch section 30. As seen in FIGS. 1 and 8, the arch protrusion 44 further includes an enlarged region 46 adjacent peripheral portion 20 on the medial side 16, designed to accomodate the inward movement of the foot after heel strike. This movement is discussed in detail below. Arch extension 44 is also preferably vertically thicker on the medial side 16 than on lateral side 18. This difference in vertical thickness of arch extension 44 can be appreciated from FIG. 8 which shows that the medial side 16 of arch extension 44 extends below the lateral side 18. Additionally, this difference in vertical thickness can be seen by comparing FIGS. 2 and 3 which show the medial side view and lateral side view of sole 10 respectively. Arch extension 44 extends further below plane P on the medial side 16 than on the lateral side 18. The manner in which this aids the walking motion of the wearer is discussed in detail below.

A plurality of grooves 48, illustrated in FIGS. 1, 2, 3 and 4, are disposed in the bottom surface 26 of the arch extension 44. Each of the grooves 48 preferably extends transversely across midsole 12, intersecting the longitudinal axis of the sole 10.

A lateral indentation 40 and a medial indentation 42, shown in FIGS. 1 and 8, are formed in arch section 30 on opposing sides of arch extension 44. The indentations 40 and 42 are formed in bottom surface 22 and extend into the sidewall of midsole 12, thereby advantageously reducing the weight of the midsole by eliminating midsole material which would otherwise be present.

As can be seen in FIG. 5, front section 32 of midsole 12 progressively increases in vertical thickness towards the arch section 30. The toe section 32 overall forms a somewhat oval shaped forefoot pad (see FIG. 1) located under the metatarsals of the wearer for cushioning same. The outer surface of pad 32 is preferably comprised of a series of contiguous convex surfaces to help prevent the shoe from catching on objects on the ground and to facilitate the rolling motion, which will become apparent in the discussion below of the walking gait. Toe section 32 also includes a raised or upwardly tapered toe area 52 which as shown in FIGS. 2, 3 and 5 is curved upwardly from plane P. A plurality of straight grooves 50, shown in FIG. 1, extend transversely across substantially the entire bottom surface of toe section 32 and are uniquely situated and angled with respect to the longitudinal axis of sole 10 to accomodate the flexing of the foot of the wearer.

With particular reference to FIG. 1, the outer sole 10 comprises two discrete substantially U-shaped sections: rearfoot outer sole section 14 and forefoot outer sole section 14', which are each secured to the peripheral portions 20 of midsole 12. More specifically, rearfoot outer sole section 14 is secured to the peripheral portion 20 of midsole heel section 28 and forefoot outer sole section 14' is secured to the peripheral portion 20 of midsole toe portion 32. Therefore the entire inner portion 22 of midsole 12 remains uncovered by the two-piece outer sole 14, 14'. Furthermore, the peripheral portion 20 of midsole arch section 30 also remains uncovered by the outer sole since both rearfoot section 14 and forefoot section 14' each terminate at the arch section 30. This unique configuration can also be understood by viewing the longitudinal sectional view of the sole shown in FIG. 5 in which the inner portion 22 is exposed and only the peripheral portion in the heel section 28 and toe section 32 are covered by outer sole sections 14 and 14' respectively. This unique sole construction advantageously contributes to the lightweight feature of sole 10 of the present invention by reducing the amount required of the heavier outer sole material. However, wear resistance of the sole is not sacrificed since the two outer sole sections 14, 14' are disposed in the areas of the sole in which have a large degree of contact with the ground. It should be noted, however, that other outer sole sections, such as one continuous peripheral outer sole section or even a unitary sole construction could be provided.

Each outer sole section 14 and 14', as discussed above, is preferably of substantially uniform thickness. Therefore, when secured to midsole 12, they cooperate with the peripheral portion 20 to support the inner portion 22 in a cantilever fashion. That is, as can be seen in FIGS. 6, 7, and 9, the angle of inclination of the bottom wall 26 of midsole 12 is maintained by uniform thickness outer sole sections 14, 14', although the angle is greater in the rear foot than in the forefoot.

Additionally, as illustrated in FIG. 1, rear foot outer sole section 14 includes a plurality of rear peripheral treads 62A and forefoot outer sole section 14' includes a plurality of peripheral treads 62B. The peripheral treads 62A, 62B preferably extend integrally from the lower surface of rear foot outer sole section 14 and forefoot outer sole section 14', respectively. The peripheral treads 62A, 62B are also preferably of uniform thickness to thereby further cooperate with peripheral portion 20 of midsole 12 and uniform-thickness outer sole sections 14, 14' to support the inner portion 22 in cantilever fashion.

Referring back to FIG. 1, a gap 64 is provided betwen adjacent treads 62A and 62B to advantageously reduce the weight of the shoe by reducing the amount of material of the treads. Furthermore, a plurality of spaces 66A, 66B are formed within the peripheral treads 62A and 62B respectively. The spaces 66B, formed within front peripheral treads 62B are aligned with the straight grooves 50 of midsole 12 in order to further aid in accommodating the flexing of the foot of the wearer. It should be understood that the shape and sizes of the peripheral treads illustrated in the drawings are only for purposes of example, since treads of other shapes and sizes could also be utilized.

Rearfoot outer sole section 14 and forefoot outer sole section 14' each include a side area 68 located on both the medial side 16 and on the lateral side 18 (FIG. 1). The side area has a lower density than the density of the other portions of the outer sole section 14, 14'. By varying the density, the weight of the sole is further reduced without having to sacrifice wear resistance of the sole or support for the foot of the wearer since the denser portions are located in the areas of the sole (e.g., toe, heel) having a greater degree of contact with the ground.

As can be appreciated from FIGS. 2 and 3, forefoot outer sole section 14' has an upwardly curved toe section 68 which cooperates with the raised toe area 52 of midsole 12. Similarly, rear foot outer sole section 14 has an upwardly curved heel 70 which cooperates with the upwardly tapered heel area 38 of midsole 12.

The shoe sole 10 of the present invention is designed to facilitate the walking motion of the wearer, but the sole construction of the present invention is not necessarily limited to a walking shoe only. For example, the shoe sole construction of the present invention can be used for a running shoe or other athletic shoe.

Upon impact of the foot of the wearer and the shoe sole 10 with the ground, heel section 30 will contact the ground first. Cantilevered midsole 12 along with the cooperating outer sole section 14 and rear peripheral treads 62A flex upwardly and laterally outwardly beyond the edge of the upper, while the inner portion 22 of midsole 12 flexes downwardly towards the ground, thereby cushioning the foot of the wearer and dissipating shock resulting from ground impact. The foot of most wearers will then roll and turn inwardly (pronate) whereupon the arch extension 44 along with the enlarged region 46 on the medial side 16 will function to further cushion the arch of the wearer. As the foot rocks forward, the arch extension 44 also functions to aid this natural rocking motion of stepping forward by further pushing the foot upwardly and forwardly. That is, since walking is a back-to-front activity in which the motion begins at the back of the shoe and then progressively moves towards the front, the arch extension 44 facilitates this movement towards the front. As the forefoot contacts the ground and flexes, the transverse grooves which are aligned with the groove between the treads will accomodate and facilitate the flexing of the foot while the forefoot pad 32 cushions the metatarsals. The contiguous convex surfaces further aid the forward rolling motion to the termination of the step at the toe.

Obviously, numerous modifications and variations of the present invention are possible in light of the above teachings. Therefore, within the scope of the appended claims, the invention may be practiced otherwise than as specifically described herein.

We claim:

1. A shoe sole construction comprising:

means for absorbing shock resulting from foot-initiated ground impact, said shock absorbing means comprising a sole having front and rear portions, lateral and medial peripheral portions and a bottom surface, said bottom surface inclined upwardly and inwardly from said medial peripheral portion and from said lateral peripheral portion to define a lateral concavity between said lateral and medial peripheral portions; and a convex arch extension disposed between said medial and lateral peripheral portions and located substantially along the longitudinal axis of the sole in the approximate area of the arch of the wearer, said arch extension extending from said sole.

2. A shoe sole construction as recited in claim 1, wherein said arch extension extends below said front and rear portions of said sole.

3. A shoe sole construction as recited in claim 2, wherein said front section and said rear section of said sole each further includes a lower density side area.

4. A shoe sole construction as recited in claim 2, wherein said sole comprises a midsole and an outer sole, said outer sole having a cutout portion extending substantially along the longitudinal axis from said front section to said rear section, and wherein said midsole extends into said cutout portion and said convex extension extends integrally from said midsole through said cutout portion.

5. A shoe sole construction as recited in claim 4, wherein said arch extension is of greater vertical thickness on its medial side than on its lateral side.

6. A shoe sole construction as recited in claim 5, wherein said arch extension includes an enlarged area adjacent said medial peripheral portion.

7. A shoe sole construction as recited in claim 6, wherein said outer sole further comprises a plurality of grooves formed in said bottom surface.

8. A shoe sole construction as recited in claim 7, wherein said front section and said rear section of said sole each further includes a lower density side area.

9. A shoe sole construction as recited in claim 1, wherein said rear portion of said sole extends below said arch extension.

10. A shoe sole construction as recited in claim 9, further comprising a plurality of treads extending from said bottom surface of said outer sole.

11. A shoe sole construction as recited in claim 10, wherein a portion of said front and rear sections are curved upwardly.

12. A shoe sole construction as recited in claim 10, further comprising a plurality of grooves formed in said bottom surface of said sole.

13. A shoe sole construction as recited in claim 1, wherein said arch extension is approximately flush with said rear portion of said sole.

14. A shoe sole construction as recited in claim 13, further comprising a plurality of treads extending from said outer sole.

15. A shoe sole construction as recited in claim 14, wherein a portion of said front and rear sections of said sole are curved upwardly.

16. A shoe sole construction as recited in claim 14, further comprising a plurality of grooves formed in said bottom surface of said outer sole.

* * * * *